United States Patent [19]

Sperandeo, III

[11] 4,076,313

[45] Feb. 28, 1978

[54] UNDERWATER RECOVERY APPARATUS

[76] Inventor: Frank P. Sperandeo, III, 3020 Autumn Branch Lane, Ellicott City, Md. 21043

[21] Appl. No.: 716,077

[22] Filed: Aug. 20, 1976

[51] Int. Cl.[2] ..... E02F 5/00

[52] U.S. Cl. ..... 299/8; 37/54; 114/295

[58] Field of Search ..... 299/8, 9; 173/1; 175/6, 175/5; 37/54, 116; 214/12, 15; 56/8; 114/295, 300; 73/425, 425.2, 421; 294/66 R

[56] References Cited

U.S. PATENT DOCUMENTS

| | | | |
|---|---|---|---|
| 2,987,836 | 6/1961 | Carlbom | 37/119 X |
| 3,113,389 | 12/1963 | Vuscovich | 56/8 X |
| 3,653,355 | 4/1972 | Christians et al. | 114/295 |

FOREIGN PATENT DOCUMENTS

| | | | |
|---|---|---|---|
| 613,326 | 10/1933 | Germany | 294/66 R |
| 6719/65 | 3/1965 | Japan | 73/425.2 |

*Primary Examiner*—Ernest R. Purser
*Attorney, Agent, or Firm*—John F. McClellan, Sr.

[57] ABSTRACT

A system for recovery of relatively small items such as treasure located on and beneath the bottom of the sea or other body of water in the form of a head having a shaft with attachment at the upper end for suspension from a ship or the like, compressed-air and oscillatory means for driving the shaft into the sea-bottom and a circular net supported by chains and by ribs radiating from pivots at the lower end and deployed outwardly by upward movement through the bottom material when the shaft is drawn upward on retrieval of the head.

8 Claims, 12 Drawing Figures

UNDERWATER RECOVERY APPARATUS

This invention relates generally to salvage apparatus and specifically to penetrating and screening devices.

Disclosure of apparatus for the purpose and in related fields appear in the following U.S. Patent Nos.:

695,068 to J. Mangold et al 3-11-02
861,859 to T. Johnstone 7-10-07
2,199,298 to J. F. White 4-30-40
2,577,625 to J. H. Page 12- 4-51
3,098,533 to C. W. Ostrom 7-23-63

Mangold et al disclose a conical receiver open at the top and with "buckets" protruding from the sides, a central rod with a reciprocable weight for driving the receiver down into the bed of a body of water, and means for raising the receiver to take the contents.

Johnstone discloses a pipe-shaped body with teeth at the lower end for penetrating a riverbed, and a removable cap at the upper end for driving the body down, an auger for passing down through the body and raising deposits from the riverbed and a doughnut-shaped screen around the top of the body for receiving deposits raised by the auger.

White discloses a well-clearing tool having a tubular body open at the bottom, with a spring-trap in the bottom.

Page discloses a wall-sampling mechanism with hollow arms pivoted at the bottom and extendable to the sides at an angle causing them to penetrate the wall of a well when the mechanism is lifted.

Ostrom discloses an underwater driving device.

However, none of the prior art known teaches or fairly suggests the structure of or provides the advantages of the present invention as contemplated by the following objects and brief description.

Principal objects of this invention are to provide a self-driving head for sea-bottom penetration which upon retrieval deploys a screen in position to sift a portion of the sea bottom for objects.

Further objects are to provide a device as described which is reliable in operation, economical to build and operate, safe and handy to maneuver into driving position and to retrieve, and which can be used in any yielding sea-bottom, whether sand, clay, silt, or any muck-type mixture.

Still further objects are to provide a device as described which employs both vibration and compressed air ejection to assist both penetration and screening, which under favorable conditions can vibrate and flush away all overburden during retrieval and return to the surface with objects sought ready to be picked from the netting without need for shipboard flushing of detritus.

In brief summary given for purposes of cursive description only and not as limitation, the invention includes a vibratory shank having suspension means at one end and pivotal ribs deploying and supporting a screen at the other end; in preferred embodiment compressed air outlets are provided in a pointed lower end on the shank and in the ribs.

The above and other objects and advantages of the invention will become more readily apparent on examination of the following description including the drawings, in which like reference numerals refer to like parts:

OVERALL STRUCTURE AND OPERATION

Figure 1:
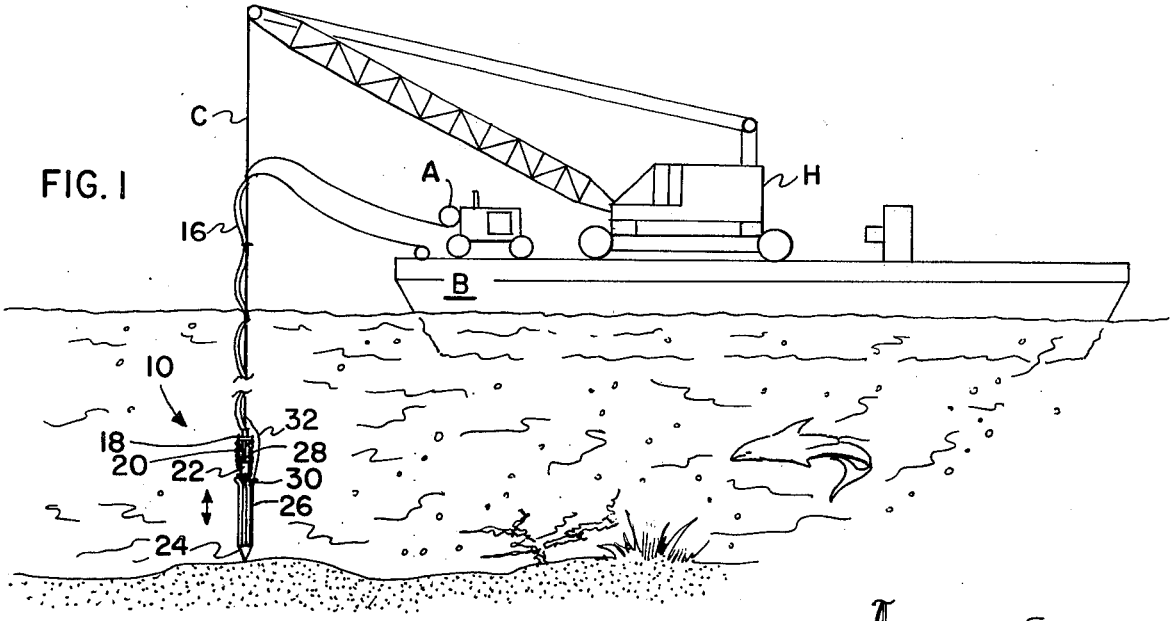
FIGS. 1 through 6 are side elevations partly in section and FIG. 7 is a side elevational detail, showing the invention in successive stages of use.

FIG. 1 shows a motor barge B with conventional compressed air supply A and hoisting means H suspending by means of a cable C air lines 16 and embodiment 10 of this invention, in the form of a self-contained unit or head having at the top a load plate 18 fixed on a spine or shank 20 running vertically the length of the unit past a vibrator 22 on the shank to a header 24 at the bottom from which plural net-support arms 26 pivot. Chains 28 attach the upper part of each arm to the load plate.

A latching split-ring 30 releasible and retrievable by a release line 32 holds the net support arms and the net, which the arms enfold and conceal in this view, in the folded position shown until oscillation of the oscillator and compressed air release through orifices in the header and arms suitably penetrate the sea bottom with the unit. It can be seen that the unit will operate without this feature, but less efficiently in some types of sea bottom.

Figure 2:
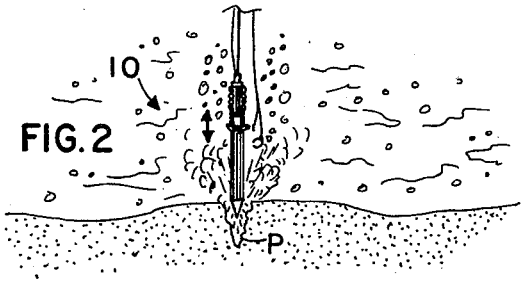

FIG. 2 shows the initial penetration P of the sea bottom and the latching split ring released and being raised.

Figure 3:
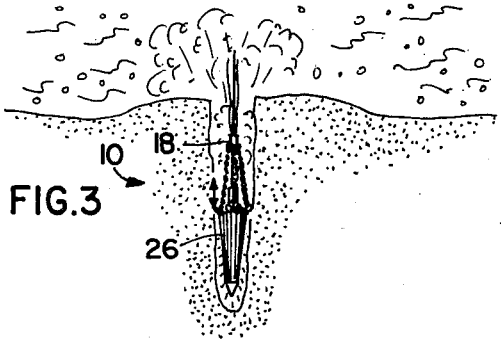

FIG. 3 shows the unit at retrieval depth with the load plate 18 beneath the surface of the sea bottom, and the arms 26 deploying outward, aided by spring of the net within the arms and by weight of the arms and chain.

Figure 4:
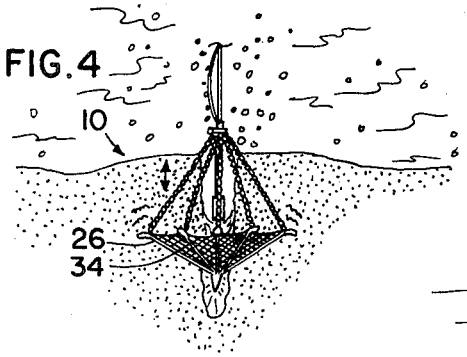

FIG. 4 shows the unit being hoisted, driving the arms 26 outward, deploying the net 34 and sifting sea bottom material through the net while vibrating and feeding compressed air through the unit to loosen and separate components of the material.

Figure 5:
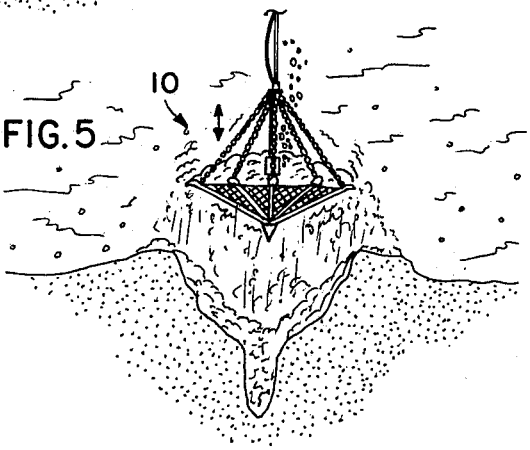
Figure 6:
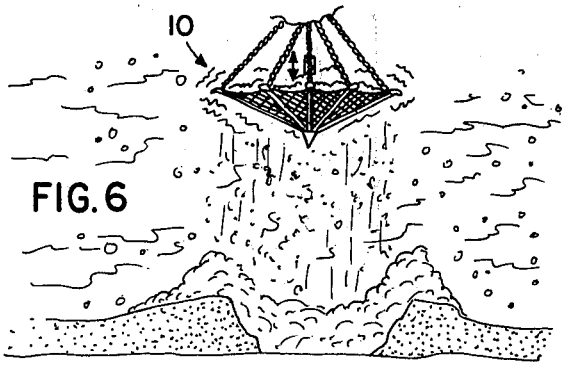

FIGS. 5 and 6 show the unit lifted clear of the bottom and continuing the power screening, aided by relative flow of the water through which lifted.

Figure 7:
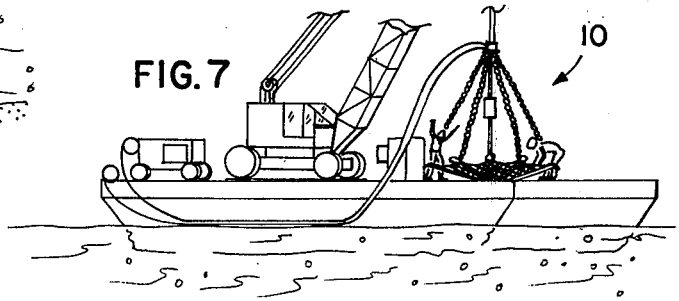

FIG. 7 shows the unit on deck, open and flushed clean of extraneous material so that screened-out objects as small as coins or as large as cannon can be lifted from the net.

STRUCTURAL DETAILS

Figure 8:
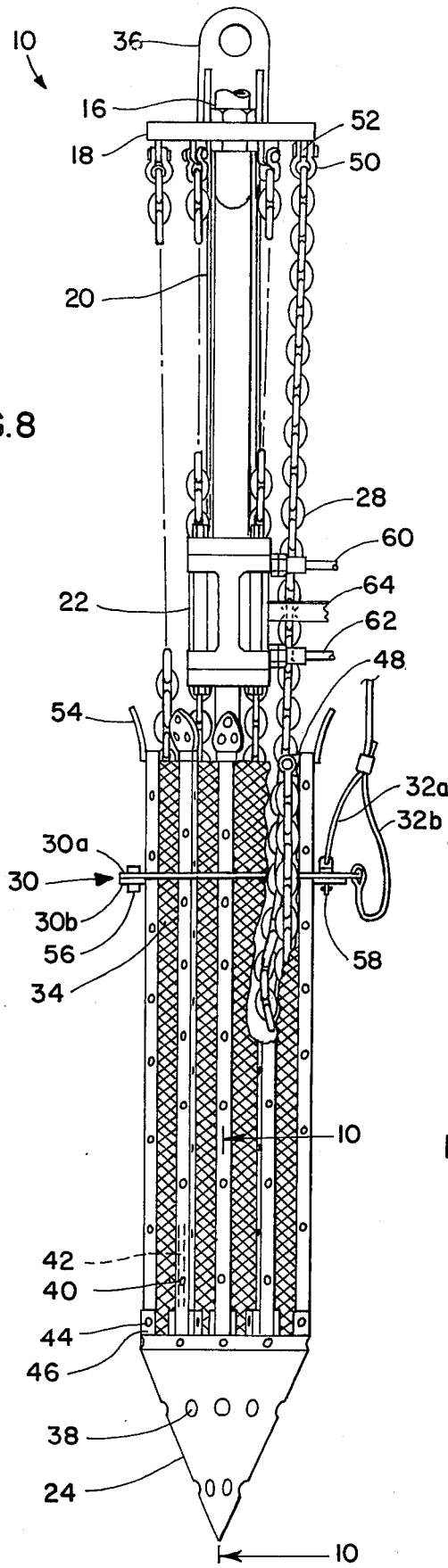
FIG. 8 is a side elevation partially broken away, showing an embodiment of the invention in folded mode.

FIG. 8 shows details of embodiment 10 as viewed in the first Figure with parts of the mechanism omitted for clarity.

Eye 36 welded to the load plate provides attachment for the cable suspending the unit. Compressed air lines 16 preferably pass through fittings in the load plate, down the shank 20, past the vibrator 22 fixed on the shank, and to a manifold supplying orifices 38 in the conical lower end of the header 24, and supplying orifices 40 in the respective arms. Each arm preferably has a series of the orifices on the outer face and similarly, but at staggered intervals on the lateral faces, all connected by an internal passage 42 in each arm.

It will be appreciated that the ejection of compressed air from the cone aids penetration and screening and that the ejection of air from the arms also aids both penetration and screening.

The lower ends of the respective arms pivot at pins 44 passing through lugs 46 upstanding on the header.

The upper ends of the arms have respective eyes 48 to which the chains 28, slack in the folded position, connect at one end; at the other end the chains connect to shackles 50 in eyes 52 in the under surface of the load plate 18.

Preferably the upper ends of the arms terminate in respective outwardly curved, upwardly pointed flukes 54.

Details of the latching split ring 30 include a pivot rivet 56 uniting one end of the near arc 30*a* and the far arc 30*b*, and a pin 58 removably attaching the other end of the arcs. The release line has a loop 32*a* attached to the eye of the pin and a longer second loop 32*b* attached to one of the arcs for retrieval when the pin is pulled.

The net 34 is visible between the arms and preferably comprises chain-link type netting for easy folding into the position shown. It may be attached at intervals to the insides of the arms as by welding or by other conventional means, but preferably is held by interior straps bolted or welded along each arm. Mesh size may be as small as one-quarter inch by one-quarter inch (6mm × 6mm).

The vibrator 22 is preferably driven by compressed air through lines 60, 62 and is preferably vented as at 64 to the surface. It preferably comprises a conventional oscillating double-action self-reversing heavy piston within the cylinder shown. A commercially obtainable unit of this type is sold by the Airmatic Tool Company of 7317 State Road, Box 6231, Philadelphia, Pa. as model "V".

The vibrator may be welded as an integral part of shank 20, and positioned as indicated to lie above the tops of the folded arms to give maximum space for the net and slack loops of chain. The air lines 16 pass around the vibrator.

Figure 9:
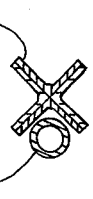
FIG. 9 is a section taken at 9—9, FIG. 10.

FIG. 9 illustrates the preferred cross-sectional shape of the shank 20, an "X" shape accommodating the air lines 16. The shank may be a weldment of four 3 by 3 inch (75 × 75 mm) angles as shown. The entire assembly except for flexing parts of the air system and internal seals is preferably of stainless steel, but may be of carbon steel, brass or bronze.

Figure 10:
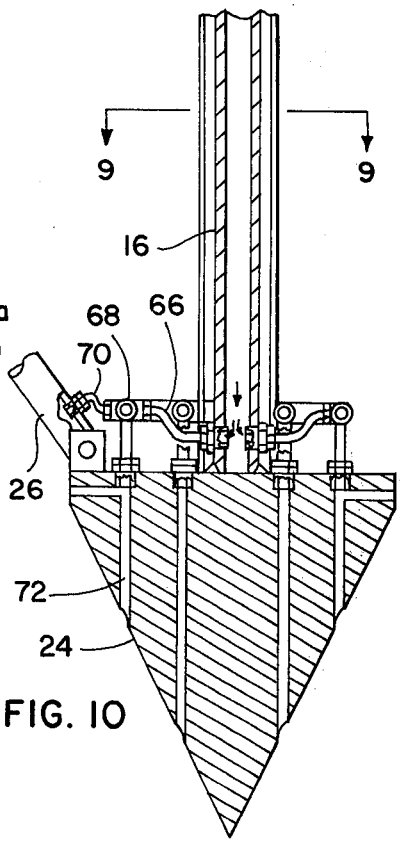
FIG. 10 is a section adapted from 10—10, FIG. 8 with structure removed for exposition.

FIG. 10 shows compressed air distribution from supply line 16 through radial tubes 66 to circular manifold 68 and from the manifold through flexible tubing 70 such as high pressure rubber tubing to the respective arms 26 and downward to passages 72 through the conical header 24.

Figure 11:
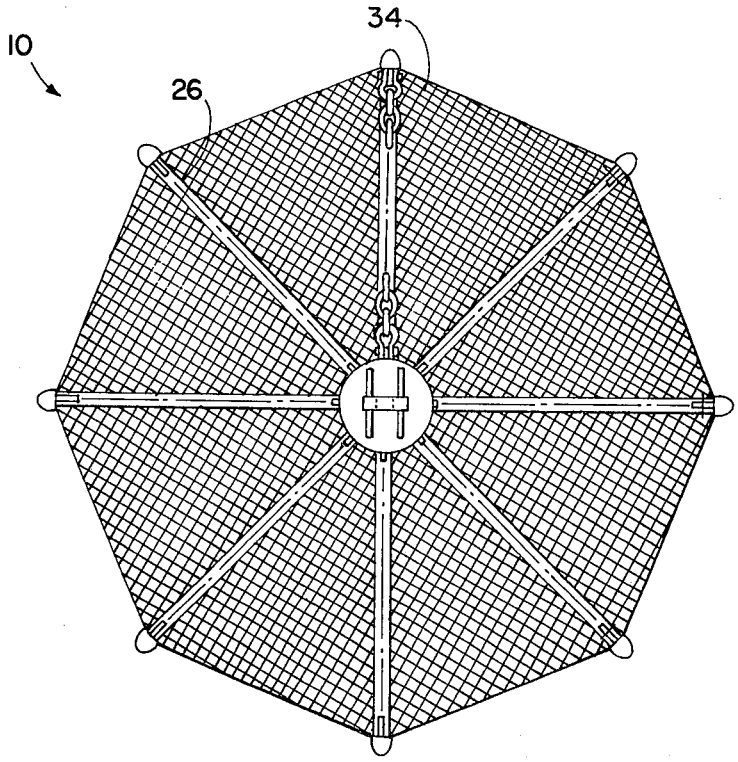
FIG. 11 is a plan detail.

FIG. 11 shows in plan view details of embodiment 10 when deployed, the arms 26 supporting and spreading the circular net 34 over the entire bottom area of the assembly.

Figure 12:
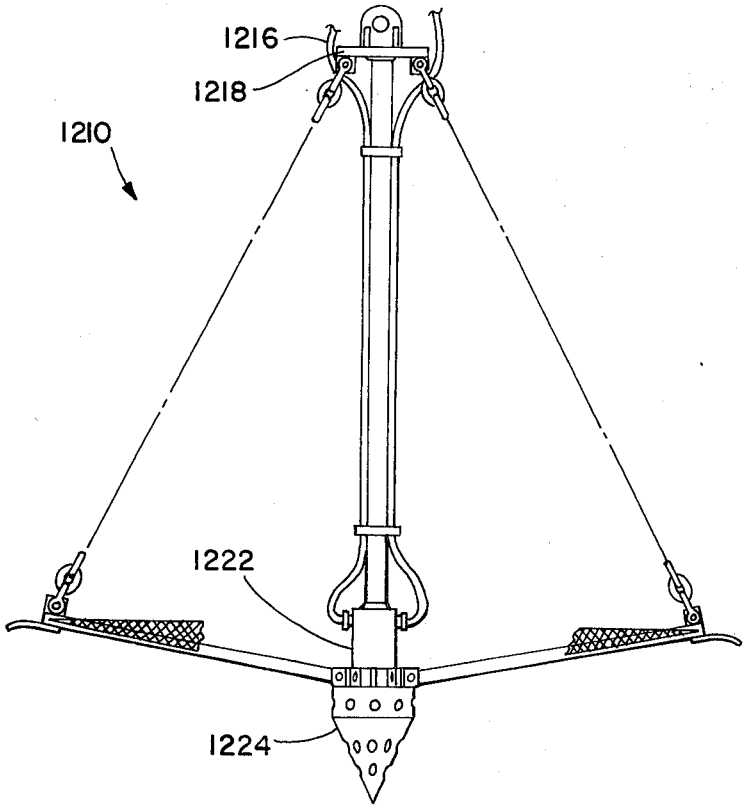
FIG. 12 is a side elevation in deployed mode with structure partially broken away for exposition of a second embodiment.

FIG. 12 shows a second embodiment 1210 in which the vibrator 1222 may be disposed for a low center of gravity as part of the header 1224; also exhaust air from the vibrator may be directly short-coupled to supply the orifices in the arms and header. The high pressure compressed air lines 1216 may be routed around the load plate 1218 as shown, for simplicity and economy.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a device for submersion in a sea bottom or the like and retrieval therefrom to secure items from the sea bottom, including: an elongate shank having an upper and a lower end, means for attachment proximate the upper end, a plurality of arms in radial array about the shank, each arm having a first end and a second end, means pivoting the first end of each arm proximate the lower end of the shank, whereby the arms can pivot from radial position to position folded along the shaft; means flexibly connecting the second end of each arm to the shank, a net supported by the arms, means for forcing the device into the sea bottom and means for spreading all said arms and net and screening material from the sea bottom on said retrieval, the improvement comprising: the means for forcing including means for vibrating said device the lower end of the shank having a conical header pointing downwardly, and means around the conical header for ejecting compressed gas downwardly for coacting with the conical header in penetrating the sea bottom.

2. In a device as recited in claim 1, the means for forcing further including means for ejecting compressed gas from the outer faces of the arms with said arms in folded position along the elongate shank.

3. In a device as recited in claim 1, the means for screening including means for ejecting compressed gas from said arms with the arms in radial position concurrently with said oscillating.

4. In a device as recited in claim 3, said means for ejecting including structure defining: a series of orifices in the outer face of each arm and a plurality of orifices in the lateral face of each arm with an internal passage connecting all said orifices.

5. In a device as recited in claim 4, the means for vibrating being an integral part of the elongate shank above the arms when the arms are in folded position along the elongate shank and below the upper end of said elongate shank.

6. In a device as recited in claim 4, the means for vibrating located on the elongate shank as part of said header.

7. In a device as recited in claim 1, the means for spreading including means for releasibly holding the arms in folded position along the elongate shank, comprising a split ring surrounding said arms, the split ring including plural arcs pivoted together, a removable pin for fastening the plural arcs around the arms, and means for removing the removable pin.

8. In a device as recited in claim 1, the elongate shank having an "X" shape in cross-section, part of the means for ejecting compressed gas having at least one conduit connecting therewith, and said at least one conduit passing down the elongate shank fitted between arms of said "X" shape.

* * * * *